US007894740B2

(12) United States Patent
Ono et al.

(10) Patent No.: US 7,894,740 B2
(45) Date of Patent: Feb. 22, 2011

(54) METHOD AND APPARATUS FOR DIRECTLY TRANSFERRING POWDER TONER, AND METHOD AND APPARATUS FOR FILLING WITH POWDER TONER

(75) Inventors: Takashi Ono, Shinzuoka-ken (JP); Kunio Makino, Shinzuoka-ken (JP)

(73) Assignee: Ricoh Company, Ltd., Tokyo (JP)

( * ) Notice: Subject to any disclaimer, the term of this patent is extended or adjusted under 35 U.S.C. 154(b) by 1184 days.

(21) Appl. No.: 11/526,761

(22) Filed: Sep. 26, 2006

(65) Prior Publication Data

US 2007/0140745 A1 Jun. 21, 2007

(30) Foreign Application Priority Data

Sep. 26, 2005 (JP) ..... 2005-277690
Aug. 29, 2006 (JP) ..... 2006-231812

(51) Int. Cl.
*G03G 21/20* (2006.01)
*B65B 1/16* (2006.01)
*B65B 1/26* (2006.01)

(52) U.S. Cl. ..... 399/92; 141/67; 141/71

(58) Field of Classification Search ..... 399/258
See application file for complete search history.

(56) References Cited

U.S. PATENT DOCUMENTS

| | | | | |
|---|---|---|---|---|
| 5,307,128 | A | 4/1994 | Murasaki et al. | |
| 6,679,301 | B2 * | 1/2004 | Makino et al. | 141/67 |
| 7,503,354 | B2 * | 3/2009 | Amano | 141/59 |
| 2003/0053826 | A1 | 3/2003 | Bares et al. | |

FOREIGN PATENT DOCUMENTS

| | | | |
|---|---|---|---|
| EP | 1 089 138 | B1 | 4/2001 |
| JP | 2001-130743 | | 5/2001 |
| JP | 2002-249101 | | 9/2002 |
| JP | 2002-337801 | | 11/2002 |
| JP | 2003-020980 | | 8/2003 |
| JP | 2005-067651 | | 3/2005 |
| JP | 2005067651 | A * | 3/2005 |

OTHER PUBLICATIONS

Fujita (JP 2005-067651 A), JPO Machine Translation.*

* cited by examiner

*Primary Examiner*—David M Gray
*Assistant Examiner*—Erika Villaluna
(74) *Attorney, Agent, or Firm*—Oblon, Spivak, McClelland, Maier & Neustadt, L.L.P.

(57) ABSTRACT

Methods of transferring powder toner and filling a toner container or a development mechanism of an electronographic image forming apparatus with powder toner include the steps of providing a toner fluidization mechanism on a surface of deposit of the powder toner stored in a toner storage container, burying the toner fluidization mechanism into the deposit, supplying gas to the powder toner, and removing fluidized toner to transfer to a different location. An apparatus for filling with powder toner includes a toner container, and an apparatus for transferring powder toner including a toner storage container, a toner fluidization mechanism buried into the powder toner, an air supply mechanism for supplying air to the toner fluidization mechanism, an air suction mechanism for removing fluidized powder toner, a transfer mechanism for transferring the removed powder toner to a different location, and a vibration application mechanism for applying vibration to the toner fluidization mechanism.

20 Claims, 10 Drawing Sheets

METHOD AND APPARATUS FOR DIRECTLY TRANSFERRING POWDER TONER, AND METHOD AND APPARATUS FOR FILLING WITH POWDER TONER

BACKGROUND OF THE INVENTION

1. Field of the Invention

The present invention relates to transferring powder, and more particularly to a method and an apparatus for fluidizing and transferring powder such as toner for electronography, and a method and an apparatus for filling a container with powder.

2. Discussion of the Background

Powder toner for electronography manufactured with a pulverization method or a polymerization method is, when manufactured, stored in a large-sized container having a capacity of approximately 80 kg, made of paper or metal, and having a drum shape. The powder toner is then divided into and stored in small-sized containers such as toner containers, toner bottles, and toner cartridges for a storage purpose. In some cases, such powder toner is stored in a small-sized developer container included in a development mechanism of an electronographic copier.

To fill a toner bottle or a toner cartridge with powder toner, the powder toner needs to be transferred into a filling machine (i.e. a filling apparatus, filling equipment, or a filling mechanism).

In a case of a background filling apparatus 200 shown in FIG. 1, after toner is put into a toner receiver located in an upper area thereof, the toner is subjected to a free fall. Therefore, transferring toner into the toner receiver of the filling apparatus requires time.

Further, since capacity of a funnel-shaped hopper 203 located in the upper area for temporally storing the transported toner is at most one half to one third of the entire capacity of the drum-shaped container, an operation for transferring toner into the hopper needs to be frequently performed.

In particular, since toner particles are apt to scatter, it is difficult for an operator to prevent the toner from scattering during the transfer operation. For example, putting approximately 15 kg of toner into a hopper takes approximately five minutes, which needs to be repeated many times. In addition, the scattering particles in the hopper make it difficult to visually check the state of remaining toner.

Further, in a case of another background filling apparatus 300 shown in FIG. 2, although toner needs not to be put into an upper part thereof, a porous plate 303 (i.e. a member for forming a fluid bed) needs to be previously arranged on a bottom of a container, and to internally pressurize the container to fluidize the toner. Therefore, the dedicated container having the porous plate 303 needs to be provided, and the toner needs to be transferred from a large-sized container into the dedicated container every time a filling operation is performed.

In the above transfer operation, the toner scatters and transferring the toner takes time.

Further, there has been such a problem that the toner becomes solidified in the toner storage container or the filling apparatus 300, and simply performing suction of the toner causes the toner to form a bridge in a suction tube. For example, transferring the toner by using an apparatus which performs only a suction operation such as a vacuum cleaner requires approximately 30 minutes, and causes powder dust to scatter, resulting in the problem that a tube of the suction machine is internally clogged with the toner, depending on a state of the toner.

Previously arranging a member for forming a fluidized bed on a bottom of a filling apparatus and applying internal pressure are preferable in keeping a stable fluidization state. However, a dedicated container previously provided with the member for forming the fluidized bed needs to be used, and the problem is that the toner needs to be transferred (loaded) into the dedicated container.

FIG. 3 illustrates a background apparatus 400 for transferring toner by rotating a toner storage container 403, and performing suction of toner from a slit opening 406 of a toner suction member.

In the background apparatus 400, in the toner storage container 403, the slit opening 406 connected to a suction nozzle 402 is provided on toner deposit. For smooth suction of toner, the entire slit opening 406 (i.e. a front edge of a suction member) needs to be moved in response to a decreasing amount of toner deposit during suction. Further, smooth suction of toner requires a mechanism for moving the front edge of the suction member downward as the toner is discharged.

In a background powder transporting apparatus 500 shown in FIG. 4, which is a fluidization and transport apparatus using a principle of toner fluidization, fluidization cannot be evenly performed since a surface of toner deposit is partially supplied with air depending on the state of fluidization.

Further, a member for forming a fluidized bed needs to be previously embedded in the toner deposit to perform a toner transport operation, resulting in occurrence of a problem such that the member for forming the fluidized bed needs to be moved as toner decreases.

FIG. 5 illustrates a background filling apparatus 600 which fills a small-sized toner container 640 with fine powder toner from a measurement tank 630 after the fine powder is transferred from a large-sized container such as a filling hopper 610. The measurement tank 630 includes, at a discharge opening 631 for discharging toner, a filling amount regulation mechanism 632 for causing the small-sized toner container 640 to be filled with the toner transferred into the measurement tank 630 in a predetermined amount by opening and closing the discharge opening 631.

SUMMARY OF THE INVENTION

This patent specification describes a method of transferring powder toner which includes the steps of providing a toner fluidization mechanism on a surface of deposit of the powder toner stored in a toner storage container, burying the toner fluidization mechanism from the surface of the deposit into the deposit, supplying gas to the powder toner from the toner fluidization mechanism in the toner storage container to fluidize the powder toner, and sucking the fluidized toner from the toner storage container to transfer the fluidized toner to a different location. This patent specification further describes a method of filling a toner container or a development mechanism of an electronographic image forming apparatus with powder toner which includes the steps of providing a toner fluidization mechanism on a surface of deposit of the powder toner stored in a toner storage container, burying the toner fluidization mechanism from the surface of the deposit into the deposit, supplying gas to the powder toner from the toner fluidization mechanism in the toner storage container to fluidize the powder toner, and sucking the fluidized toner from the toner storage container to transfer the fluidized toner to the toner container or the development mechanism. This patent specification further describes an apparatus for filling with powder toner which includes a toner container, and an apparatus for transferring powder toner including a toner storage container configured to store the powder toner, a toner fluidization mechanism which is inserted into and separated from the toner storage container and which fluidizes the powder toner while being buried into the powder toner, an air supply mechanism configured to supply air to the toner fluidization mechanism to fluidize the powder toner, an air suction mechanism configured to suck the fluidized powder toner from the toner storage container, a transfer mechanism configured to transfer the sucked powder toner from the toner storage container to a different location, and a vibration application mechanism configured to apply vibration to the toner fluidization mechanism to cause the toner fluidization mechanism to be buried into deposit of the toner powder in the toner storage container.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
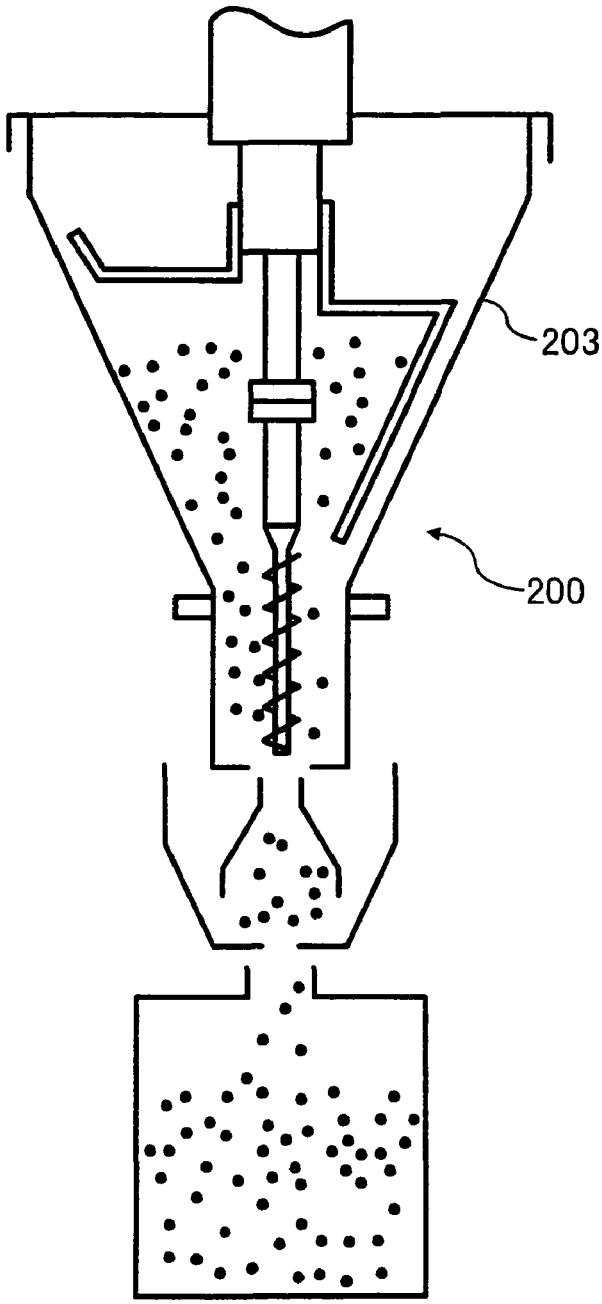
FIG. 1 BACKGROUND ART
FIG. 1 is an explanative illustration of a background filling apparatus using an auger method.
Figure 2:
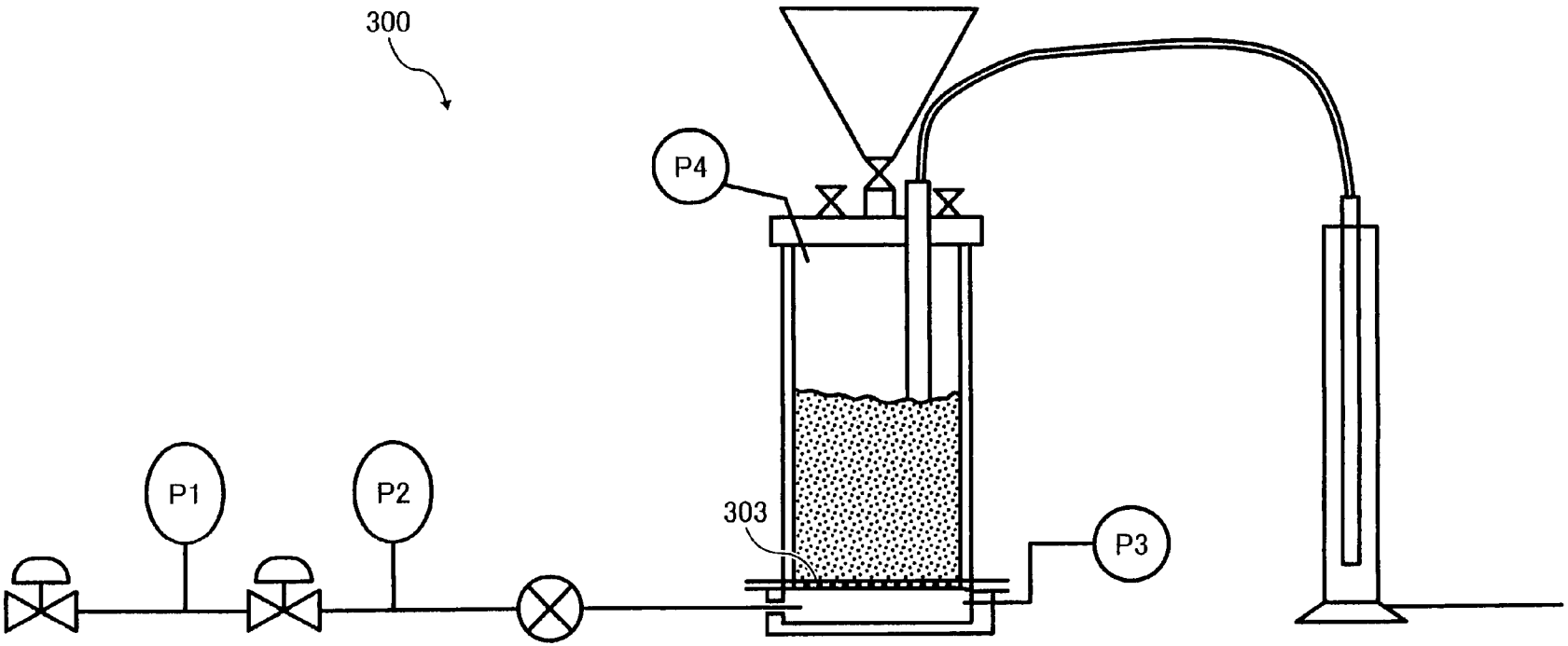
FIG. 2 BACKGROUND ART
FIG. 2 is an explanative illustration of another background filling apparatus.
Figure 3:
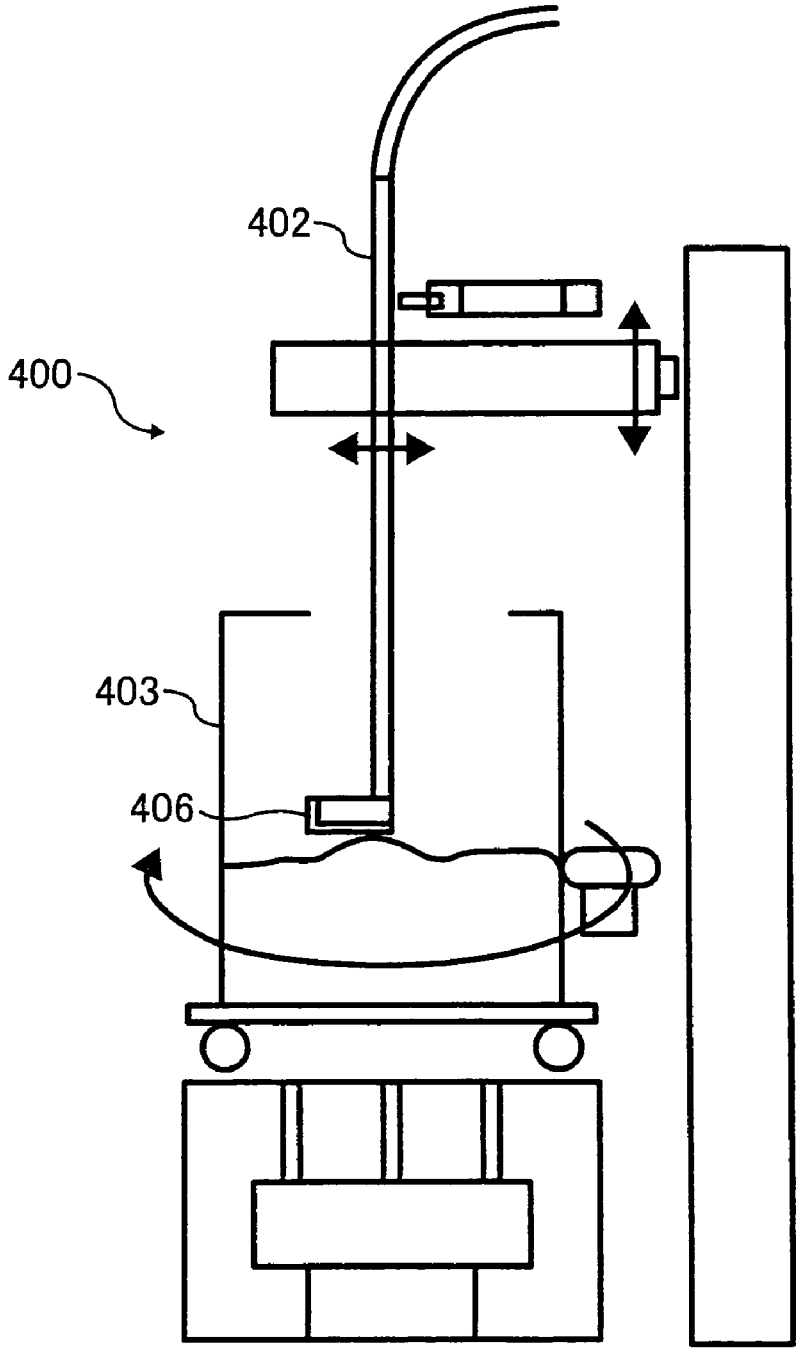
FIG. 3 BACKGROUND ART
FIG. 3 is an explanative illustration of a background apparatus for transferring toner by rotating a powder container.
Figure 4:
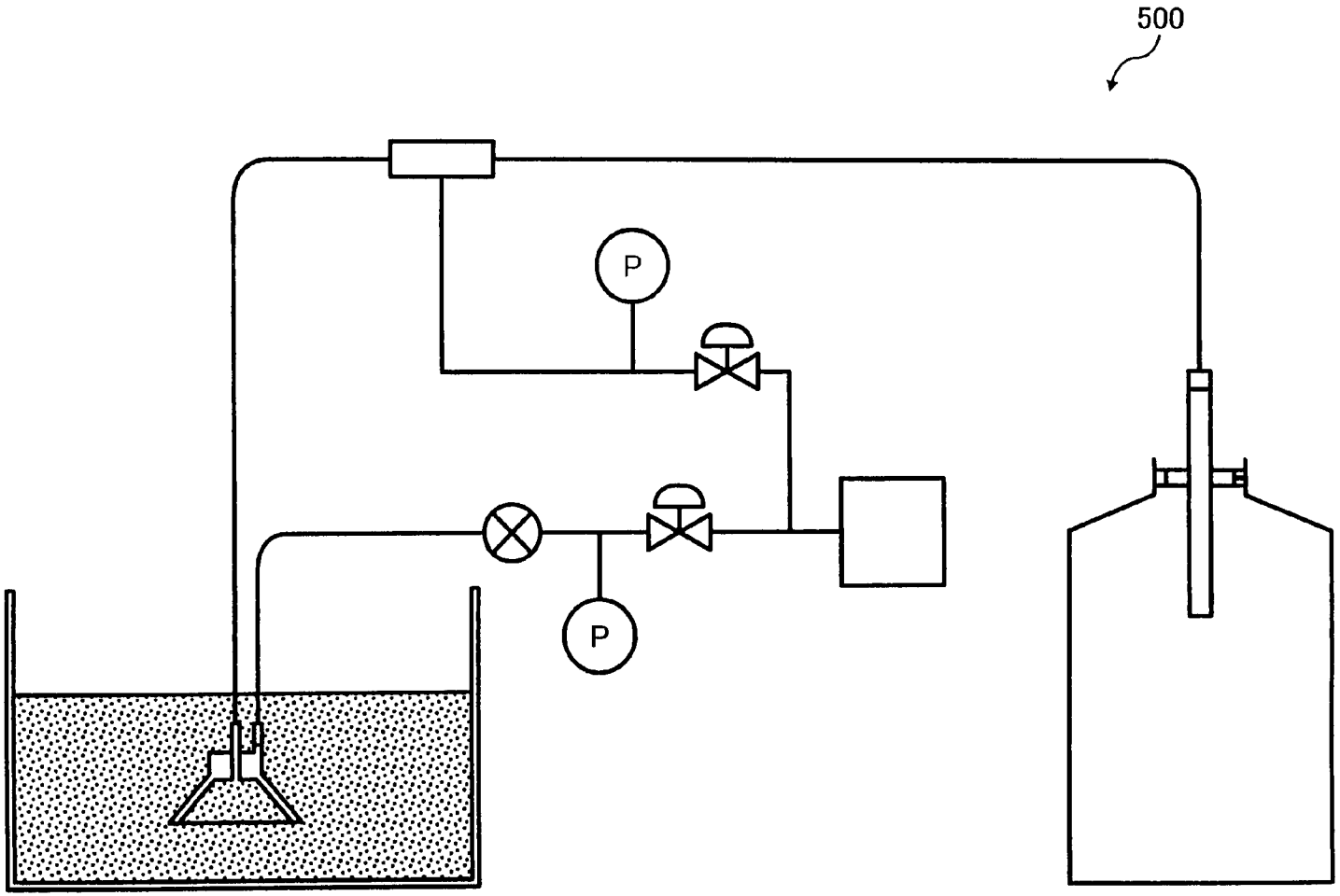
FIG. 4 BACKGROUND ART
FIG. 4 is an explanative illustration of a background powder transfer apparatus using a principle of toner fluidization.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner. Referring now to the drawings, wherein like reference numerals designate identical or corresponding parts throughout the several views, particularly to FIGS. 6A and 6B, a toner transfer apparatus according to an exemplary embodiment of the present invention is described.

Figure 6A:
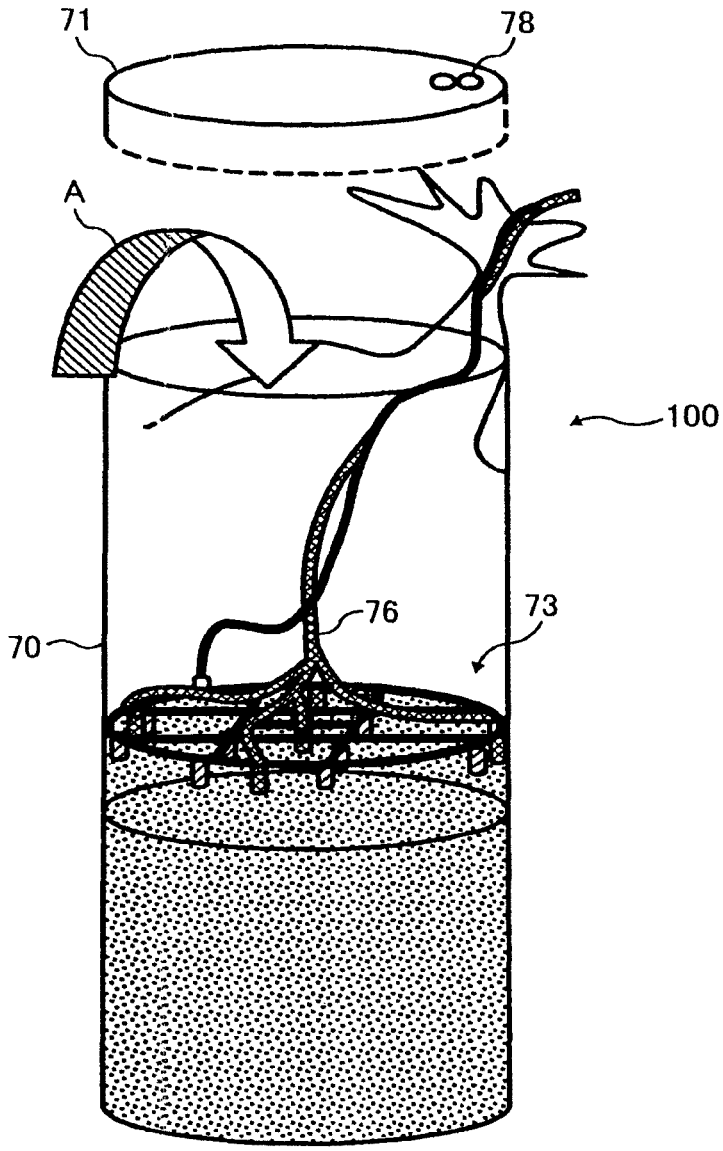
FIGS. 6A and 6B are illustrations of an overview of an exemplary toner transfer apparatus including a toner fluidization mechanism and a toner transfer mechanism according to the present invention.

FIG. 6A is a view for explaining a method and an apparatus for transferring toner according to the present invention.

As shown in FIG. 6A, an exemplary toner transfer apparatus 100 includes a toner storage container 70 having a drum shape, a lid 71, arranged in an openable and closable manner, which serves as a sealing mechanism, a toner fluidization mechanism 73, a toner transfer mechanism 76, and a hole 78.

Figure 6B:
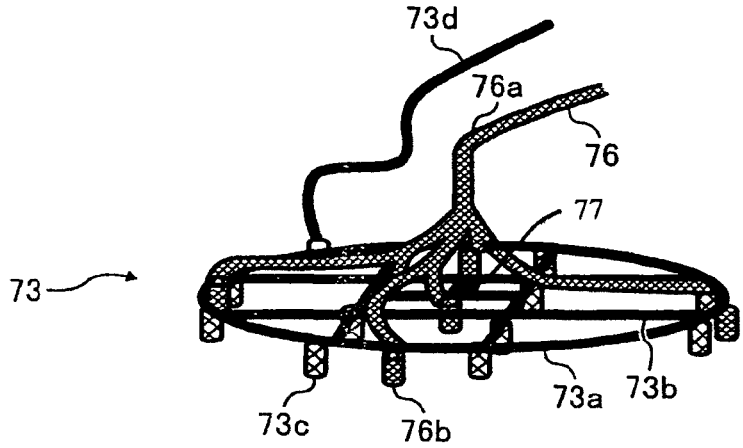

The toner fluidization mechanism 73 is enlarged in FIG. 6B. As shown in FIG. 63, the toner fluidization mechanism includes a circular tube 73*a*, a plurality of grid pipes 73*b*, a plurality of air blow parts 73*c*, and an air tube 73*d* for fluidizing toner.

The toner transfer mechanism 76 includes a toner transfer tube 76*a* and a toner suction member 76*b*.

The plurality of grid pipes 73*b* are arranged in a matrix in an inner area of the circular tube 73*a*, and are connected to the circular pipe 73*a*. Also, the plurality of grid pipes 73*b* are connected to each other at crossing points thereof. The air blow part 73*c* includes a sintered body formed by sintering an inorganic granular material so that a micropore for connection is created. The plurality of air blow parts 73*c* are properly arranged under the circular tube 73*a* and the grid pipe 73*b*. The air tube 73*d* for fluidizing toner is arranged at a single point on the circular tube 73*a*. Alternatively, the air tube 73*d* may be arranged at a plurality of points on the circular tube 73*a*.

The toner transfer mechanism 76 is supported by the toner fluidization mechanism 73, and the toner transfer tube 76*a* is branched at a front portion, and each front of branches is provided with the toner suction member 76*b*. The toner transfer mechanism 76 discharges toner stored in the toner storage container 70 and transfers the toner to a different location.

The toner storage container 70 does not necessarily have a drum shape. Any container suitable for storing toner may be used. For example, it is preferable that an area of an opening does not greatly change along a change in a surface level of stored toner as the toner is discharged and reduced. The lid 71 of the toner storage container 70 may be pivotable with a hinge. Alternatively, the lid 71 may be laterally slidable. The lid 71 includes a top plate provided with the hole 78 for putting the air tube 73*d* for fluidizing toner and the toner transfer tube 76*a* therethrough.

The toner fluidization mechanism of the toner transfer apparatus 100 according to an exemplary embodiment of the present invention is not limited to the toner fluidization mechanism 73. Further preferably, the toner fluidization mechanism 73 has such a structure that the toner fluidization mechanism 73 sinks in toner deposit stored in the toner storage container 70 after being arranged therein to uniformly fluidize the toner deposit by a method such as aeration and vibration, and that the angle of the toner fluidization mechanism 73 does not change to prevent toppling of the toner fluidization mechanism 73 along with reduction of the toner deposit. For example, the toner fluidization mechanism 73 may have a thin bottom having an area similar to the horizontal cross section of the toner storage container 70 so that the toner fluidization mechanism 73 does not topple. Alternatively, the toner fluidization mechanism 73 may be provided with a bar member having a top which contacts an inner wall of the toner storage container 70 when the toner fluidization mechanism 73 tilts so that the toner fluidization mechanism 73 does not topple. Alternatively, the toner fluidization mechanism 73 may be provided with a guide bar described below, or may have, for example, a cylindrical shape so that an attitude thereof does not change even when the toner fluidization mechanism 73 topples. It is preferable that the toner fluidization mechanism 73 includes a through-hole so that the toner fluidization mechanism 73 can be easily buried into toner deposit.

In the method of transferring toner by using the exemplary toner transfer apparatus 100 according to an exemplary embodiment of the present invention, the toner fluidization mechanism 73 is put in the toner storage container 70 previously storing toner together with the toner transfer mechanism 76. The air tube 73*d* and the toner transfer tube 76*a* are loosely inserted to the hole 78. Then, the lid 71 is closed, and the toner fluidization mechanism 73 is activated to evenly fluidize the toner in the toner storage container 70. The toner transfer mechanism 76 is activated to suction and transfer the toner from a fluidized surface thereof.

According to an exemplary embodiment of the present invention, the toner fluidization mechanism 73 is arranged on a surface of powder toner deposit stored in the toner storage container 70, and, in a next step, is buried into the deposit from the surface, thereby ejecting fluidization gas only in the deposit so that the toner is efficiently fluidized. At the same time, the toner to be transferred into a different location may be prevented from being stirred up, and an operation for transporting the toner from the toner storage container 70 into a filling apparatus may be omitted. Further, fluidized toner may be directly discharged from the toner storage container 70 and be transferred into a different location. The different location refers to, for example, a toner container such as toner bottles and toner cartridges or a developer container in a development mechanism of an electronographic copier.

It is preferable that the toner fluidization mechanism 73 according to an exemplary embodiment of the present invention has an apparent density not less than the apparent powder density of toner deposit so that the toner fluidization mechanism 73 can be easily buried into the toner deposit from a surface of the toner deposit in the toner storage container 70. Such a toner fluidization mechanism 73 is conventionally known as a porous member for even ventilation. The toner fluidization mechanism 73 is, in general, connected to a vent pipe (e.g. a flexible vent pipe), and gas for fluidizing toner is externally introduced through the vent pipe. The vent pipe is held by, for example, a hand, and the toner fluidization mechanism 73 may be externally inserted into the toner storage container 70 and arranged on the surface of the toner deposit in the toner storage container 70, and the toner fluidization mechanism 73 after being used may be removed from the toner storage container 70. In other words, the toner fluidization mechanism 73 and the vent pipe may be integrally formed (i.e. the vent pipe may be flexible, and, of course, is attachable to and detachable from the toner fluidization mechanism 73). Therefore, the surface of the toner deposit on which the toner fluidization mechanism 73 is arranged is applied with a weight of the toner fluidization mechanism 73 (which may preferably be a porous structure having connected holes) and a partial weight of the vent pipe (i.e. the porous structure).

In an exemplary embodiment of the present invention, the toner fluidization mechanism 73 is inserted to the toner storage container 70 storing the powder toner, arranged on the surface of the toner deposit, and, then, preferably enters and is buried into the toner deposit. The entry, in general, gradually progresses by, for example, vibration.

The entry of the toner fluidization mechanism 73 into the toner deposit is preferably performed before fluidizing the powder toner by externally supplying fluidization gas to the toner fluidization mechanism 73 in the toner storage container 70, during the fluidization of the powder toner, during a step of performing suction and discharge of the fluidized powder toner from the toner storage container 70, or, while the fluidized powder toner is transferred to a different location. More preferably, the entry of the toner fluidization mechanism 73 into the toner deposit takes place before the fluidization gas is externally supplied to the toner fluidization mechanism 73 in the toner storage container 70 to fluidize the powder toner while preventing the toner from being stirred up due to commencement of aeration. At the same time, it is preferable that the entry of the toner fluidization mechanism 73 into the toner deposit takes place also in the step of performing the suction and discharge of the fluidized powder toner from the toner storage container 70 so that the toner fluidization mechanism 73 can keep the depth even when the surface level of the toner deposit falls with time.

The toner fluidization mechanism 73 is preferably buried at a depth in which a top portion thereof is covered by a toner layer, although the sufficient depth may not be completely determined because the stirring up of the toner depends on intensity of aeration (such as ventilation pressure, quantity of airflow, and an aeration zone), and distribution and diameters of holes of the porous member of the toner fluidization mechanism 73.

In an exemplary embodiment of the present invention, as the toner fluidization mechanism 73 ejects air into the toner, the toner fluidization mechanism 73 enters into the toner deposit by self-weight.

Further, the toner fluidization mechanism 73 preferably includes a vibration generation apparatus 77, as shown in FIG. 6B. As the vibration generation apparatus 77 included in the toner fluidization mechanism 73 vibrates, the toner fluidization mechanism 73 enters into the toner deposit by self-weight.

The entry of the toner fluidization mechanism 73 into the toner deposit is achieved by self-weight of the toner fluidization mechanism 73 due to fluidization of the toner deposit. For smoother entry, it is preferable that the toner fluidization mechanism 73 is vibrated in addition to the fluidization of the toner deposit. Generating vibration is particularly preferable at a first stage in which the toner deposit has not yet been fluidized. Ultrasonics may be used as a means for vibrating the toner fluidization mechanism 73, for which airflow into the toner deposit may be preferably used. Ultrasonics may apply vibration to the entire toner storage container 70. Alternatively, the toner fluidization mechanism 73 may be provided with an ultrasonic transmission mechanism (e.g. a strained steal mesh) so that ultrasonics can apply vibration only to the toner fluidization mechanism 73. In the case, apparent density of the toner fluidization mechanism 73 increases. Further, intermittent ventilation is preferably used to apply vibration to the toner fluidization mechanism 73. A preferred embodiment and a preferred frequency for the application of vibration are described below in detail. When the frequency of vibration is too low, sufficient entry may not be achieved. When the frequency of vibration is too high, external additive may be separated from toner particles.

Powder toner for use with the toner transfer apparatus 100 generally has a volume average particle size of 2.5 to 15.0 μm, an absolute specific gravity of 1.02 to 1.45, and an apparent powder density of 0.20 to 0.90 g/cm$^3$, and includes external additives.

It is preferable that the powder toner increases in volume by a factor of 1.2 to 15.0 in the toner storage container 70 due to ventilated fluidization.

Further, it is preferable that in the step of arranging the toner fluidization mechanism 73 on the surface of the toner deposit, the toner fluidization mechanism 73 is arranged on the surface of the toner deposit in the toner storage container 70 at a slant in a range of ±30 degrees from a horizontal position.

The toner fluidization mechanism 73 is arranged at a slant of, preferably, ±30 degrees, more preferably, ±2 to ±20 degrees, and even more preferably, ±2 to ±5 degrees (i.e. kept substantially horizontal) against the toner storage container 70 so that fluidization conditions on the toner surface may be kept uniform.

Further, when the toner fluidization mechanism 73 enters the toner deposit at an angle in the above slant angle ranges, the toner fluidization mechanism 73 keeps entering to a bottom of the toner storage container 70 without contacting a wall of the toner storage container 70.

As described above, the toner fluidization mechanism 73 is preferably able to easily achieve an airflow rate of 2.0 to 18.0 L/min, more preferably, 5.0 to 15.0 L/min, and even more preferably, 8.0 to 13.0 L/min.

Further, the toner fluidization mechanism 73 is preferably able to easily achieve an air pressure of 0.01 to 0.5 Mpa, more preferably, 0.03 to 0.3 Mpa, and even more preferably, 0.05 to 0.25 Mpa.

Since toner is transported from a factory by a motortruck, while being shaken in a container during the transport, the container is filled with the toner at higher density than the density upon factory shipment due to the shake. As a result, the surface of the toner becomes considerably hard, making it difficult for the toner fluidization mechanism 73 to sediment depending on a toner condition even when the surface is simply fluidized.

To solve the above difficulty, vibration is applied to the toner fluidization mechanism 73 so that the toner fluidization mechanism 73 can enter into in the toner storage container 70 even when the surface of the toner is hardened during the transport.

It is preferable that the frequency is 300 to 40,000 vibrations per minute, more preferably, 10,000 to 30,000 vibrations per minute, and even more preferably, 20,000 to 25,000 vibrations per minute.

The vibration generation apparatus 77 is preferably located at a position 0.5 to 50.0 mm higher than a position of the toner fluidization mechanism 73.

In order to vibrate the toner, it is preferable that the toner fluidization mechanism 73 is provided with the vibration generation apparatus 77 at approximately the center thereof, and a housing holding the toner fluidization mechanism 73 is formed of a metal or the like which better transmits vibration.

Vibration may be applied by a motor, air, or the like. Using the air valve of the toner fluidization mechanism 73 to apply vibration allows sharing of the unit with the toner fluidization mechanism 73, and the facility is prevented from being complicated.

Pressure of an air vibrator is 0.05 to 5.0 Mpa, preferably, 0.1 to 2.5 Mpa, and more preferably, 0.15 to 2.0 Mpa.

The sediment speed of the toner fluidization mechanism 73 may be controlled by changing a vibration condition.

The toner fluidization mechanism 73 is provided with a guide bar for causing the toner fluidization mechanism 73 to vertically fall upon sediment. The guide bar prevents the toner fluidization mechanism 73 from hitting an internal wall of the toner storage container 70 and stopping due to shake of the toner transfer apparatus 100.

Further, the toner transfer mechanism 76 is provided with a filter such as a stainless steal mesh having openings of 0.3 to 1.0 mm. The filter is provided to the toner suction member 76*b* of the toner transfer mechanism 76 so that a foreign body included in the toner storage container 70 is prevented from being mixed into a toner container product.

Further, providing a protrusion to a lower part of the toner fluidization mechanism 73 prevents the toner fluidization mechanism 73 from reaching a bottom of the toner storage container 70.

As described above, the toner in a fluidized state has powder density of, for example, approximately 0.33 g/cc, and therefore the volume thereof is considerably smaller than those in background methods. The big difference between the present method and background methods is observed in a ventilation volume, in other words, air-intake. Further, not pressurizing the powder toner upon transfer results in a decrease in stress imposed on the powder toner. Further, as a presence of the fluidized bed improves transfer capacity of the powder toner, the transfer capacity thereof is three to four times the transfer capacity of simply ventilated toner powder.

Powder toner preferably used in the toner transfer apparatus 100 has a volume average particle size of 2.5 to 15.0 μm, more preferably 3.0 to 12.0 μm, and even more preferably 5.0 to 9.0 μm, and has an absolute specific gravity of 1.02 to 1.45, and more preferably 1.1 to 1.3. Further, the powder toner preferably has a powder density of 0.20 to 0.90 g/Cm$^3$, and more preferably 0.35 to 0.85 g/cm$^3$, and includes external additives. Such powder toner achieves a remarkable effect.

It is preferable to feed air in such an amount to increase the volume of the toner in the toner storage container 70 by 1.2 to 15.0 times, and preferably 1.5 to 5.0 times.

Further, when the quantity of air is introduced to transfer toner having powder density of, for example, approximately 0.47 g/cm$^3$, the density of the toner immediately after the transfer is lowered to approximately 0.25 g/cm$^3$.

In detail, toner may be transferred at high density of up to approximately 0.35 g/cm$^3$.

In an exemplary embodiment of the present invention, since the pressure applied to the toner transfer apparatus 100 is not large, an electric power source with 24V to 220V can be used. A high-pressure cylinder can be used for ventilation, and a battery or natural energy such as solar and wind power can also be used.

Further, a compressor can be preferably used for a ventilation mechanism.

Figure 5:
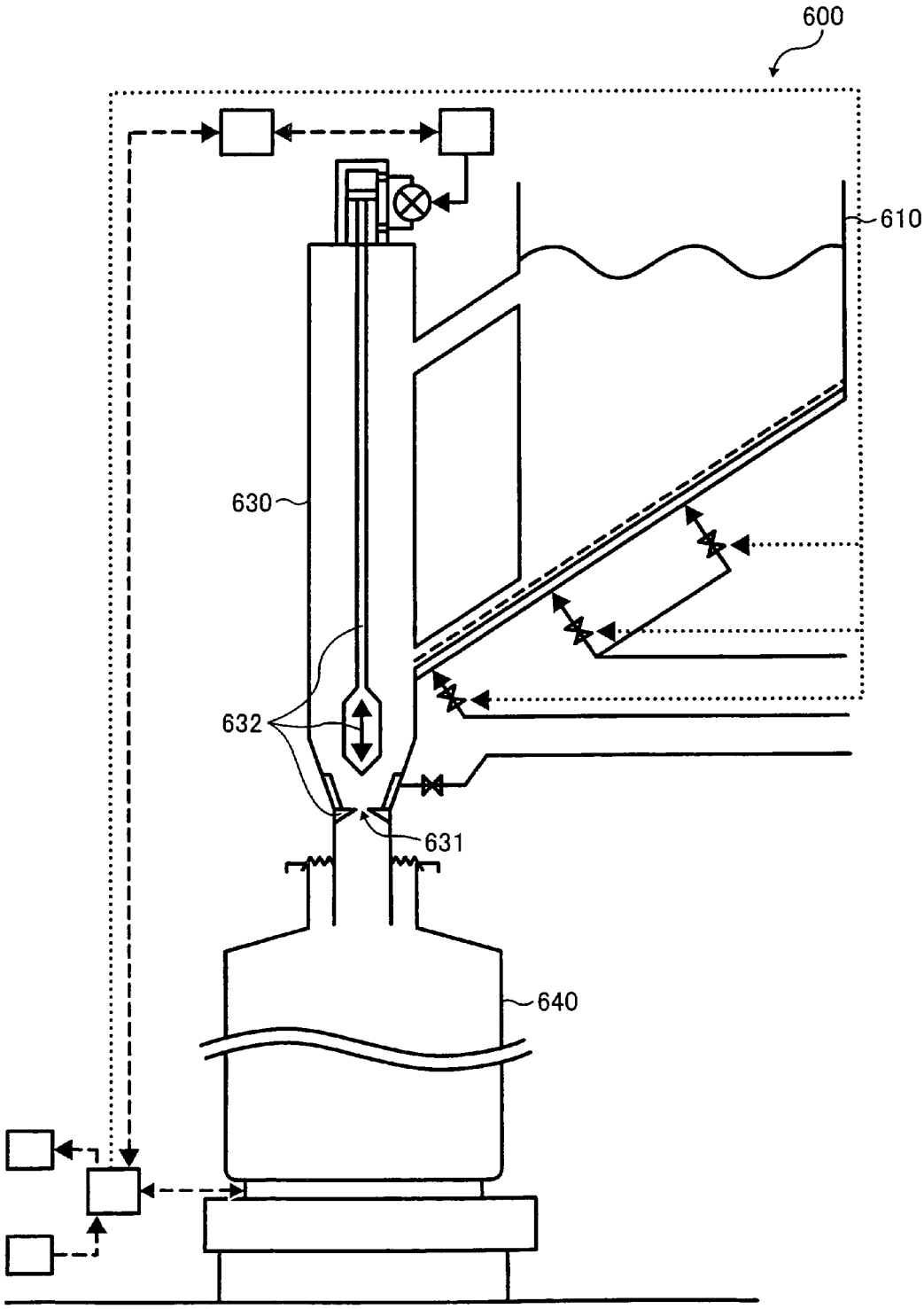
FIG. 5 BACKGROUND ART
FIG. 5 is an illustration of a background filling apparatus.
Figure 7:
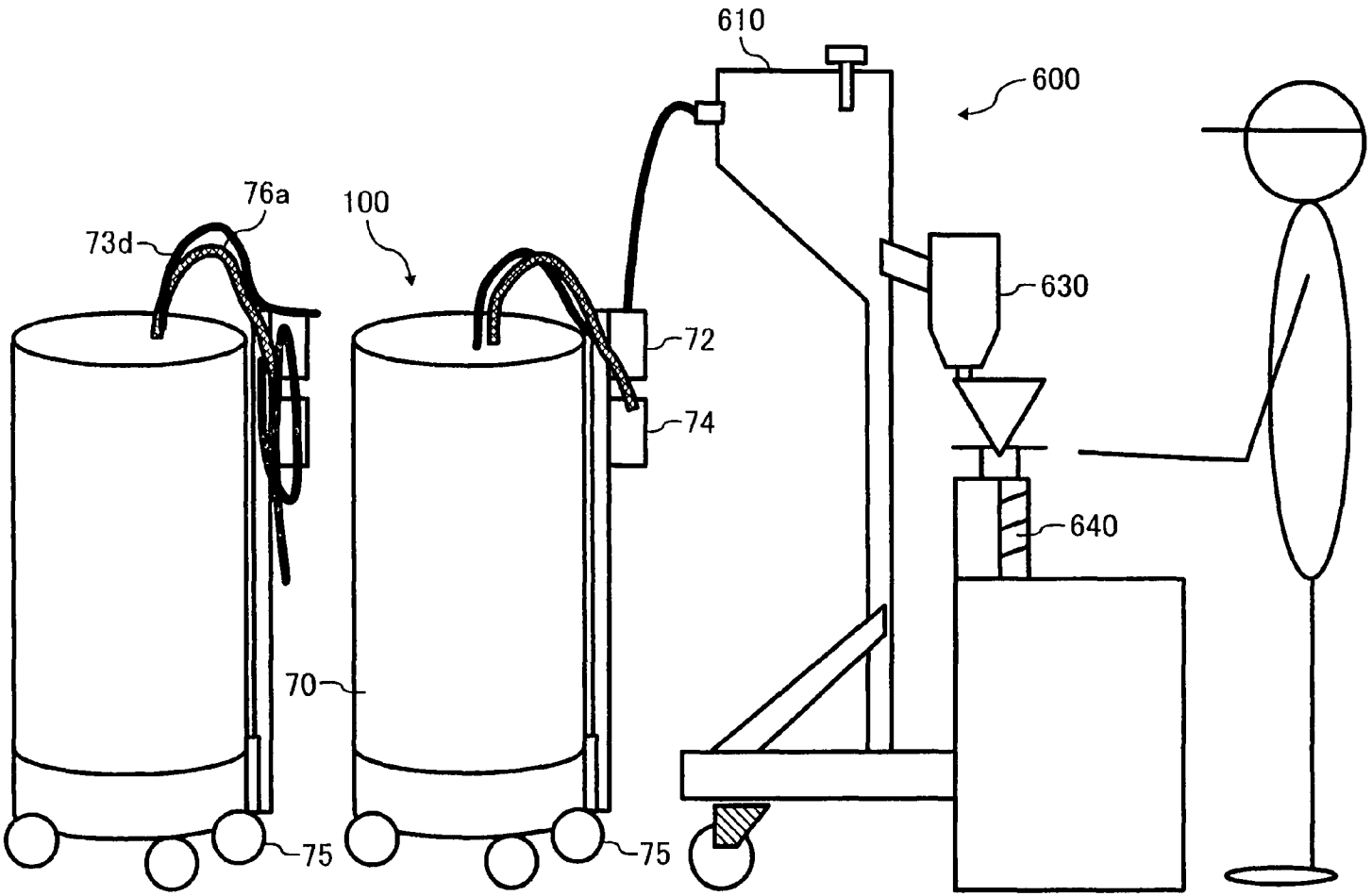
FIG. 7 is an illustration of a combination of the exemplary toner transfer apparatus shown in FIGS. 6A and 6B and the background filling apparatus shown in FIG. 5.

FIG. 7 is a view for explaining a filling operation using the toner transfer apparatus 100 and the background filling apparatus 600 shown in FIG. 5.

The toner storage container 70 shown in FIG. 7 is provided with a roller 75 for easy transportation thereof. The toner storage container 70 is further provided with a joint 72 for connecting to a transfer tube extended from a different location (e.g. a hopper of the background filling apparatus 600) so that toner may be transferred to the different location, and a tube station 74 for holding the air tube 73*d* for fluidizing toner and the toner transfer tube 76*a*.

With the above configuration, since the toner may be transferred into the hopper of the background filling apparatus 600 from the toner storage container 70, automation of toner transfer may be easily achieved.

Conventionally, toner needs to be carried in small-sized packets onto the background filling apparatus 600, and the total amount of the toner to be carried is less than a half of a volume of the toner storage container 70, which is at most 20 to 30 kg in a case the volume of the toner storage container 70 is approximately 80 kg.

Figure 8:
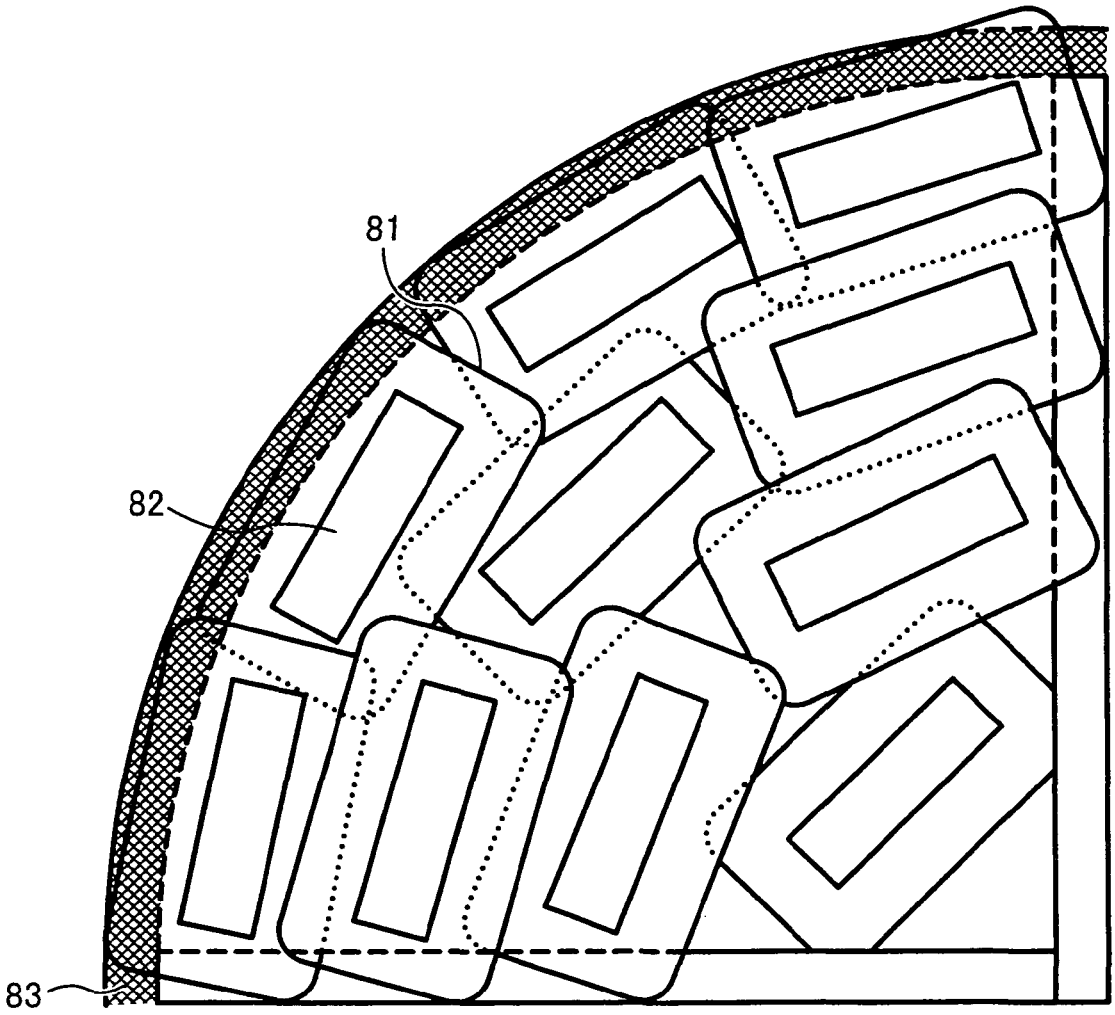
FIG. 8 is an illustration of an enlarged view of fluidization of toner.

FIG. 8 is an enlarged view for explaining exemplary fluidization of toner. In the example, the toner fluidization mechanism 73 (shown in FIGS. 6A and 6B) includes a holding member 83 and a plurality of fluidization cylinders 82 as shown in FIG. 8. The fluidization cylinder 82 corresponds to the air blow part 73*c* of the exemplary toner transfer apparatus 100 shown in FIGS. 6A and 6B. One of the plurality of fluidization cylinders 82 fluidizes the toner within a range 81. The fluidization range of the toner fluidization mechanism 73 is determined based on each range 81.

The configuration of the toner fluidization mechanism 73 is not limited to the configurations shown in FIGS. 6A, 6B, and 8.

Figure 9A:
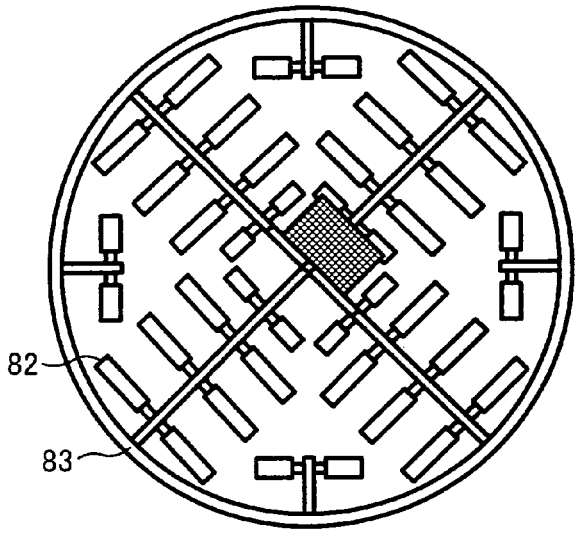
FIGS. 9A, 9B, and 9C are illustrations of exemplary variations of configurations of the toner fluidization mechanism.
Figure 9B:
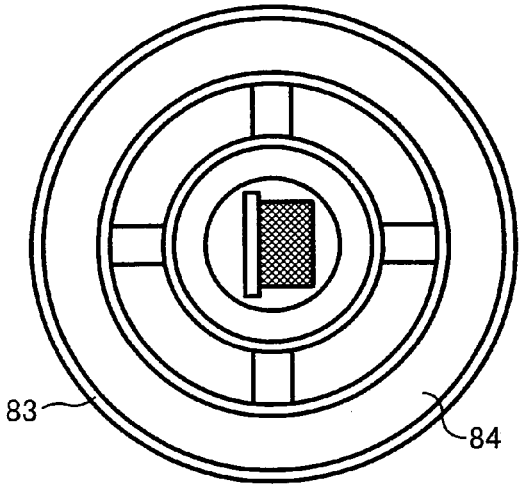
Figure 9C:
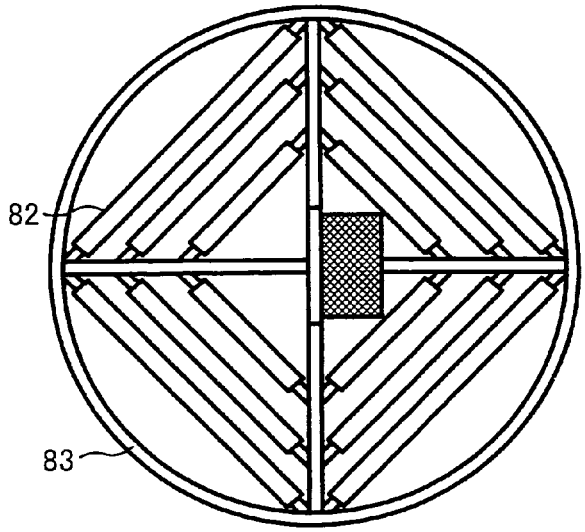

FIGS. 9A, 9B, and 9C illustrate examples of the toner fluidization mechanism 73 (shown in FIGS. 6A and 6B). FIG. 9A illustrates an exemplary arrangement of the plurality of fluidization cylinders 82 in the toner transfer mechanism 73. FIG. 9B illustrates the air blow part 73*c* (shown in FIGS. 6A and 6B) serving as a fluidized bed. FIG. 9C illustrates another exemplary arrangement in which the plurality of fluidization cylinders 82 are supported at left and right sides thereof so as to increase strength.

In FIG. 9A, fluidization is performed along a circumference of the supporting member 83 having a circular shape. In FIG. 9B, fluidization is performed along a vertical direction. In FIG. 9C, fluidization is performed at a center and an outer circular part of the circular supporting member 83.

Figure 10A:
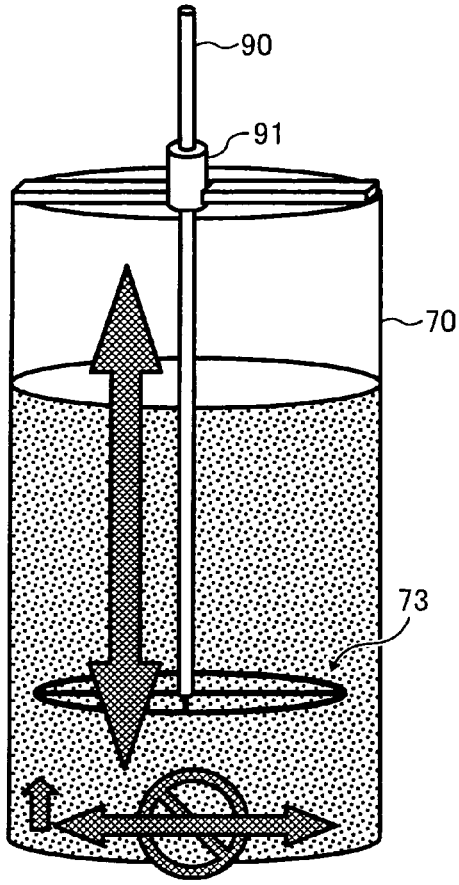
FIG. 10A is an illustration of the toner fluidization mechanism provided with a guide bar.

FIG. 10A illustrates an exemplary guide bar 90 provided to the toner fluidization mechanism 73 as described above. As shown in FIG. 10A, the toner fluidization mechanism 73 may be provided with the guide bar 90 and an exemplary guide stay 91.

Using the guide bar 90 causes the toner fluidization mechanism 73 to vertically sediment in the toner storage container 70 even when the toner is reduced as the toner is transferred. Using the guide bar 90 further prevents the toner fluidization mechanism 73 from hitting an internal wall of the toner storage container 70 and stopping.

It is preferable that a joint of the toner fluidization mechanism 73 with the guide bar 90 includes rubber, vinyl, or a spring so that the vibration generated by the vibration generation apparatus 77 included in the toner fluidization mechanism 73 is efficiently transmitted only to the toner fluidization mechanism 73.

Figure 10B:
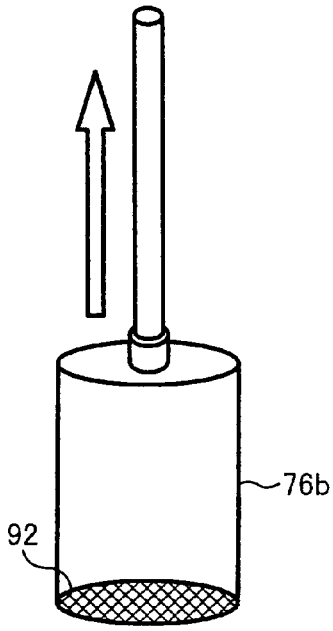
FIG. 10B is an illustration of the toner transfer mechanism provided with a filter.

FIG. 10B illustrates an exemplary stainless steal mesh 92 provided to the toner transfer mechanism 76 (shown in FIGS. 6A and 6B), which serves as the filter as described above. The stainless steal mesh 92 is provided to the toner suction member 76*b* so that a foreign body included in the toner storage container 70 is prevented from being mixed into a toner container product.

EXPERIMENT

An exemplary filling operation was performed by using the exemplary toner transfer apparatus 100 as shown in FIG. 6A. The filling operation described below is an exemplary case, and does not limit a technical scope of the present invention.

Red toner having a weight of 80 kg, a volume average particle size of 6.8 μm, and a powder density of 0.47/cc was transferred by using the toner transfer apparatus 100 shown in FIG. 6A under the following fluidization conditions.

The toner transfer was completed in 30 minutes. Scattering of toner particles was not observed during the toner transfer.

Fluidization Conditions

Fluidized air-intake: 12.0 L/min

Fluidized air pressure: 0.1 Mpa

Frequency: 24,000/minute

Air vibrator pressure: 0.2 Mpa

When toner transfer was performed by simply using a suction apparatus in a similar manner, toner particles scattered. A suction part of the suction apparatus was choked with toner during the transfer, and operation of the apparatus was needed to stop for cleaning a plurality of times. The toner transfer took 45 minutes.

This patent specification is based on Japanese patent applications, No. JP2005-277690 filed on Sep. 26, 2005, and NO. JP2006-231812 filed on Aug. 29, 2006 in the Japan Patent Office, the entire contents of each of which are incorporated by reference herein.

What is claimed is:

1. A method of transferring powder toner, comprising:

providing a toner fluidization mechanism on a surface of a deposit of the powder toner stored in a toner storage container, the toner fluidization mechanism being separate from the toner storage container;

burying the toner fluidization mechanism from the surface of the deposit into the deposit by vibrating the toner fluidization mechanism;

supplying gas to the powder toner from the toner fluidization mechanism in the toner storage container to fluidize the powder toner; and removing the fluidized toner from the toner storage container to transfer the fluidized toner to a different location.

2. The method of transferring powder toner according to claim 1, wherein the different location is one member selected from a group consisting of toner containers and development mechanisms of electronographic image forming apparatuses.

3. The method of transferring powder toner according to claim 1, wherein the toner fluidization mechanism is configured to have a surface apparent density of not less than an apparent density of the deposit of the powder toner, the burying the toner fluidization mechanism is performed at least one time before the supplying the gas to the toner from the toner fluidization mechanism in the toner storage container to fluidize the powder toner, and during the supplying the gas to the toner from the toner fluidization mechanism in the toner storage container to fluidize the powder toner, the removing the fluidized toner includes suctioning the fluidized toner from the toner storage container to transfer the fluidized toner to the different location.

4. The method of transferring powder toner according to claim 1, wherein the providing the toner fluidization mechanism comprises:

providing the toner fluidization mechanism on the surface of the deposit in the toner storage container in such a manner that the toner fluidization mechanism on the surface of the deposit in the toner storage container is slanting at an angle of +30 to −30 degrees from a horizontal plane.

5. The method of transferring powder toner according to claim 1, wherein the powder toner has a volume average particle size of 2.5 to 15.0 μm, an absolute specific gravity of 1.02 to 1.45, and a powder density of 0.20 to 0.90 g/cm$^3$, and includes external additives.

6. The method of transferring powder toner according to claim 1, wherein the powder toner is increased in volume by a factor of 1.2 to 15.0 in the toner storage container when fluidized.

7. The method of transferring powder toner according to claim 1, wherein providing the toner fluidization mechanism comprises:

containing the powder toner in the toner storage container; and setting the toner fluidization mechanism on the surface of the deposit of the powder toner.

8. The method of transferring powder toner according to claim 1, wherein the supplying gas comprises:

supplying air to the toner fluidization mechanism at an airflow rate of 2.0 to 18.0 L/min.

9. The method of transferring powder toner according to claim 1, wherein the supplying gas comprises:

supplying air to the toner fluidization mechanism at a pressure of 0.01 to 0.5 Mpa.

10. The method of transferring powder toner according to claim 1, wherein the toner fluidization mechanism has a guide bar to prevent the toner fluidization mechanism from hitting an internal wall of the toner storage container.

11. The method of transferring powder toner according to claim 1, wherein the removing the fluidized toner is performed through a toner suction opening provided with a mesh.

12. The method of transferring powder toner according to claim 11, wherein the toner fluidization mechanism has a protrusion on a lower part thereof.

13. The method of transferring powder toner according to claim 1, wherein the gas is supplied by an air supply mechanism including a mechanism for generating the gas activated by a power supply of 24V to 220V.

14. The method of transferring powder toner according to claim 13, wherein the air supply mechanism comprises a compressor.

15. The method of transferring powder toner according to claim 13, wherein at least one of the air supply mechanism and an air suction mechanism for removing the fluidized toner uses solar or wind energy or a combination thereof.

16. The method of transferring powder toner according to claim 13, wherein the air supply mechanism includes a high-pressure cylinder.

17. A method of filling a toner container or a development mechanism of an electronographic image forming apparatus with powder toner, comprising:

providing a toner fluidization mechanism on a surface of a deposit of the powder toner stored in a toner storage container, the toner fluidization mechanism being separate from the toner storage container;

burying the toner fluidization mechanism from the surface of the deposit into the deposit by vibrating the toner fluidization mechanism;

supplying gas to the powder toner from the toner fluidization mechanism in the toner storage container to fluidize the powder toner; and removing the fluidized toner from the toner storage container to transfer the fluidized toner to the toner container or the development mechanism.

18. An apparatus for filling with powder toner, comprising:

a toner container; and an apparatus for transferring powder toner including:

a toner storage container configured to store the powder toner;

a toner fluidization mechanism which is inserted into and separated from the toner storage container and which fluidizes the powder toner while being buried into the powder toner;

an air supply mechanism configured to supply air to the toner fluidization mechanism to fluidize the powder toner;

an air suction mechanism configured to remove the fluidized powder toner from the toner storage container;

a transfer mechanism configured to transfer the removed powder toner from the toner storage container to a different location; and a vibration application mechanism attached to the toner fluidization mechanism and configured to apply vibration to the toner fluidization mechanism to cause the toner fluidization mechanism to be buried into a deposit of the toner powder in the toner storage container.

19. The apparatus for filling with powder toner according to claim 18, wherein the vibration application mechanism is positioned at a center of the toner fluidization mechanism.

20. The apparatus for filling with powder toner according to claim 18, further comprising:

a guide bar to prevent the toner fluidization mechanism from hitting an internal wall of the toner storage container, wherein the guide bar is attached to the toner fluidization mechanism via a joint that prevents vibration of the toner fluidization mechanism generated by the vibration application mechanism from being transferred to the toner storage container.

* * * * *